United States Patent [19]

Hodge

[11] 3,942,592

[45] Mar. 9, 1976

[54] DRILL STEM MAKE-UP AND BREAK-OUT SYSTEM FOR EARTH DRILLING MACHINES

[75] Inventor: Lee Roy Hodge, Houston, Tex.

[73] Assignee: Hughes Tool Company, Houston, Tex.

[22] Filed: Aug. 12, 1974

[21] Appl. No.: 497,172

[52] U.S. Cl. ..... 173/157; 173/164; 175/85; 166/77.5

[51] Int. Cl.[2] ..... E21C 1/10

[58] Field of Search ..... 173/157, 158, 152, 163, 173/164, 149; 175/85; 214/2.5; 81/57.11–57.14; 166/77.5

[56] References Cited

UNITED STATES PATENTS

| | | | |
|---|---|---|---|
| 3,158,213 | 11/1964 | O'Neill et al. | 175/85 |
| 3,460,638 | 8/1969 | Millsapps | 175/85 |
| 3,695,363 | 10/1972 | Kelly | 175/85 X |
| 3,696,872 | 10/1972 | Jonsson | 173/164 X |
| 3,719,237 | 3/1973 | Flick | 173/163 X |

*Primary Examiner*—David H. Brown
*Attorney, Agent, or Firm*—Robert A. Felsman

[57] ABSTRACT

A system for use in the make-up or break-out of drill stem members of earth boring machines having a hydraulically operated power swivel to rotate the drill stem and hydraulic cylinders to raise and lower the swivel. A first, variable volume pump supplies fluid to the hydraulic cylinder through a four-way valve. A servo pump controller, connected with this valve and operable by variable resistors, establishes the linear make-up and break-out speeds for the power swivel. A second, variable volume and reversible pump supplies fluid to the power swivel means. A second servo pump controller, connected with the second pump and operable by variable resistors, establishes selected linear rotational travel speeds for the power swivel. Make-up torque is controlled by an electrical solenoid activated pressure compensator connected with the second pump, and linear speed is similarly controlled.

8 Claims, 1 Drawing Figure

DRILL STEM MAKE-UP AND BREAK-OUT SYSTEM FOR EARTH DRILLING MACHINES

BACKGROUND OF THE INVENTION

1. Field of the Invention

This invention relates in general to earth boring machines and in particular to improved means to make-up or break-out drill stem members of such machines.

2. Description of the Prior Art

There are commercially available machines which utilize hydraulic cylinders to forcibly move in a linear, upward or downward direction a power swivel, which is commonly driven by a hydraulic motor and pump. When adding or subtracting a drill stem member to the total string of such members, the power swivel is rotated while back-up tongs or equivalent hold a portion of the drill string to cause make-up or break-out of a selected rotary connection in the string. When the connection is broken, for example, the lead of the threads of the drill stem members forces the power swivel in one linear direction or another. Thus, the hydraulic cylinders used to control the linear direction and speed of the swivel must move linearly with the rotational speed of the swivel. Otherwise, the mechanism may strip the threads.

SUMMARY OF THE INVENTION

This invention is directed to an improvement that correlates the linear speed of retraction of the hydraulic cylinders and attached power swivel with rotational speed of the power swivel. This correlation must accommodate differing sizes of drill stems and associated thread, as well as differing thread leads. As a consequence, the drilling machine may be used with a large variety of drill stem diameters and thread leads. The improvement comprises the use of a first, variable volume pump to supply hydraulic fluid to the hydraulic cylinder through a four-way valve that controls the linear travel of the cylinder. A servo pump controller, connected through this valve and operable by electrical means such as variable resistors, establishes the make-up and break-out linear speeds for the power swivel. A second, variable volume and reversible pump supplies fluid to rotate the power swivel means. A second servo pump controller, connected with the second pump and operable by electrical means such as variable resistors, establishes selected rotary speeds for the power swivel. Make-up torque is limited, preferably by an electrical solenoid activated pressure compensator connected with the second pump, to insure a higher available break-out torque than the maximum possible make-up torque.

The above as well as other object features and advantages of the invention will become more fully apparent in the following description of the preferred embodiment.

DESCRIPTION OF THE PREFERRED EMBODIMENT

Figure 1:
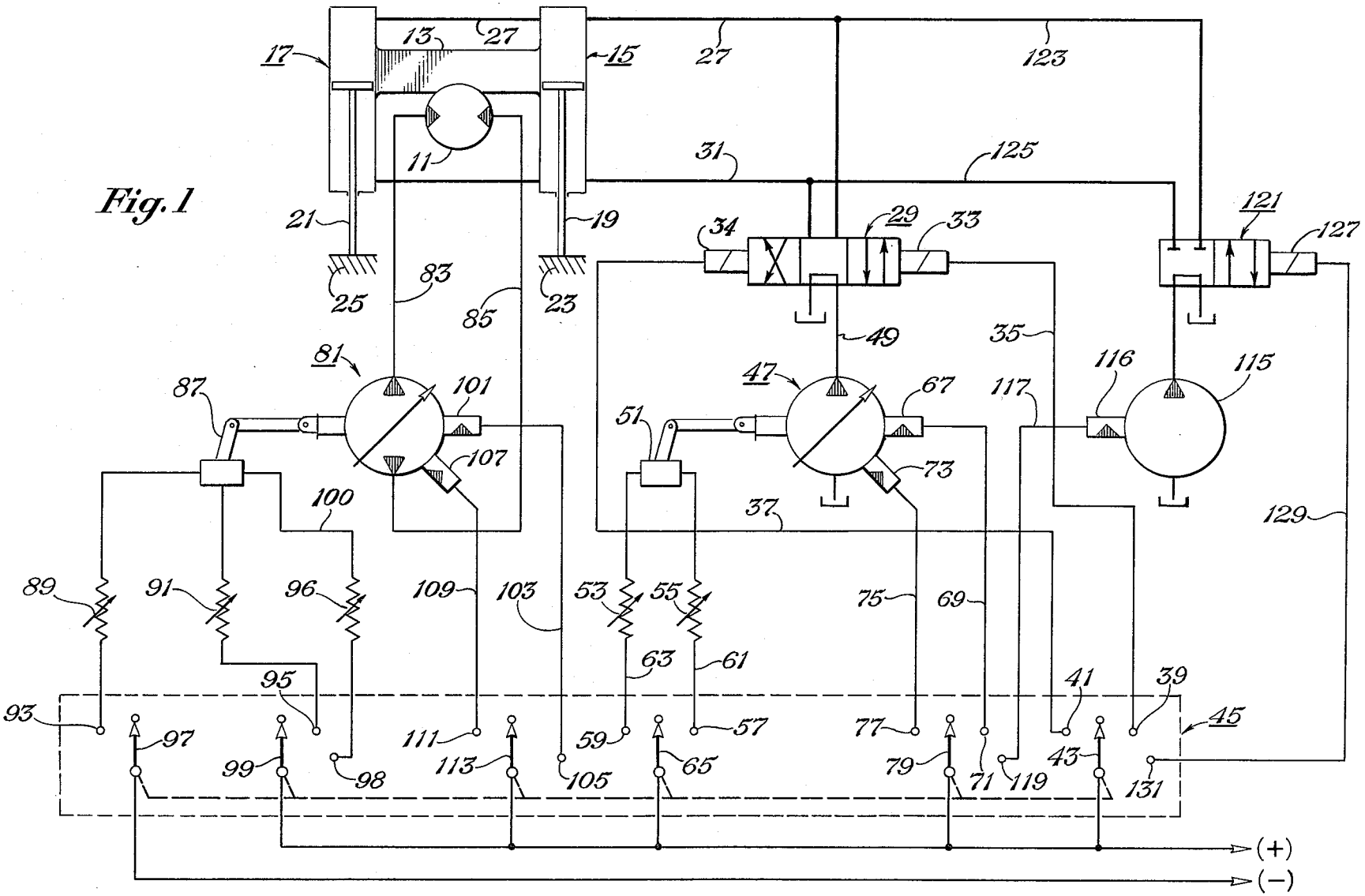
FIG. 1 is the sole FIGURE of the drawing and illustrates schematically a combined electro-hydraulic system in accordance with the principles in the invention.

The numeral 11 in the drawing designates a power swivel including a hydraulic motor supported in the conventional manner on a cross member 13 which is powered for linear, upward or downward movement on a drilling mast (not shown), typically by a pair of hydraulic cylinders 15, 17. The cylinder housings are attached to the cross member 13, and the piston ends 19, 21 are secured to the mast as indicated by the numerals 23, 25. A hydraulic line 27 is connected with the housings of the cylinders and to a valve means 29, which as shown in FIG. 1 is a four-way, three-positioned solenoid operated directional valve of conventional construction. The solenoids 33, 34 are connected by conductors 35, 37, respectively to two terminals 39, 41, adapted to be opened or closed by a pole 43 of a switch designated generally by the numeral 45.

A first pump means 47, which is a variable volume hydraulic pump, is connected by hydraulic line 49 to the valve means 29. The output volume of this pump is determined by an electro-mechanical servo pump controller which as shown in FIG. 1 comprises a first control means 51 that includes a first variable resistor 53 to determine a selected make-up linear speed for the power swivel, and a second variable resistor 55 to determine a selected break-out linear speed for the power swivel. These resistors are connected to terminals 59, 57 respectively through electrical conductors 63, 61. A pole 65 is adapted to supply current through either resistor 53 or resistor 55. A first electrical solenoid activated pressure compensator control 67 is connected through conduit 69 to terminal 71. A second electrical solenoid activated pressure compensator 73 is connected by conductor 75 through terminal 77. A pole 79 is adapted to close with terminal 71 and 77 to energize either the first pressure compensator 67 or the second pressure compensator 73 associated with the first pump means 47.

A second, variable volume and also reversible pump means 81 is connected hydraulically with power swivel 11 by hydraulic lines 83, 85. A second control means 87, which is also a pump volume control actuator of the electro-mechanical servo type is electrically controlled by a pair of variable resistors 89, 91 to terminals 93, 95 of the switch 45, which may be closed by the poles 97, 99. Another variable resistor 96 connects the control means 87 with a terminal 98 through conductor 100.

An electrical solenoid activated pressure compensator control 101 comprises a first pressure compensator control means associated with the second pump means 81 and connected with a conductor 103 to a terminal 105. A second such pressure compensator control 107 is connected by conduit 109 to a terminal 111. The pole 113 is adapted to close terminal 111 or 105 in the switch 45.

A drilling pump 115 and its solenoid activated pressure compensator 116 is connected by a conductor 117 with terminal 119. The hydraulic output of pump 115 supplies a four-way, two-position valve 121, which selectively directs fluid to the hydraulic cylinders 15, 17 through lines 123, 125 connected respectively with lines 27, 31. The valve 121 is operated with a solenoid 127 connected by conductor 129 with the terminal 131 of switch 45.

In operation, movement of switch 45 to the drilling mode closes poles 43, 79, 113 and 99 respectively with terminals 131, 119, 105 and 98. Pump 115 is energized along with solenoid 127 to position valve 121 to supply fluid to the hydraulic cylinders 15, 17 to thrust the power swivel 11 downward. Simultaneously, pressure compensator 101 is activated to establish selected output pressure for pump 81. The output volume of the pump may be selectively varied through the variable resistor 96, which controls the setting of control means 87. As a consequence, the pump 81 rotates the swivel 11 at a selected speed during drilling.

To add a drill stem member, switch 45 is moved to its break-out mode which closes poles 43, 79, 65 and 99 with terminals 39, 71, 57 and 95. Drilling pump 115 is deactivated and the pressure in lines 123, 125 bleeds by deactivation of the solenoid 127 of valve 121 when switch 45 is moved to the break-out mode. Closing pole 43 with terminal 39 energizes solenoid 33 and moves valve 29 to a position to move the power swivel 11 upward. The closing of pole 79 with terminal 71 activates pressure compensator 67 of the first pump means 47 to establish a selected break-out pressure in the hydraulic cylinders. Also, pole 65 closes with terminal 57 to energize through variable resistor 55 to first control means 51 to establish the selected output volume of the pump 47. The linear upward speed of the power swivel is thus determined. In addition, when pole 99 closes with terminal 95 the second control means 87 is activated to a selected position through variable resistor 91 to determine the rotational speed of the second pump means 81 and the power swivel 11. The variable resistors 91 and 55 serve as means to synchronize the linear displacement and rotational speed of the swivel to correlate with the lead of the threads of the drill stem during make-up and break-out. The resistors are adjusted to correlate power swivel 11 rotational and linear speeds with the particular drill stem and thread combination. Thus swivel speed is matched with thread lead to prevent thread damage.

After break-out an additional drill stem member is added and readied for make-up. Switch 45 is positioned to its make-up mode whereby poles 43, 79, 65, 113 and 97 close respectively with terminals 41, 77, 59, 111 and 93. Therefore, solenoid 34 positions the valve 29 to urge cylinders 15, 17 downward. Also, second pressure compensator 73 establishes the selected output pressure for its first pump means 47. Variable resistor 53 is adjusted such that the first control means 51 established the selected output volume for pump 47. Thus, the power swivel 11 moves downward at a selected force and speed. Simultaneously, the output pressure of the second pump means 81 is established by activation of pressure compensator 107. The output volume of pump 81 may be selectively varied with variable resistor 89 and second control means 87. Therefore, the output torque and rotational speed of the power swivel may be controlled. Swivel speed may be matched with thread lead to prevent thread damages.

It will be apparent to those of average skill in view of the above description that the invention has significant advantages. Among them are the advantages which follow from having selectivity in the output volume of the motors that control the rotational and linear speeds of the power swivel. The linear speed control permits differing drilling rates, as well as make-up and break-out speeds. The output volumes of the first and second motors may be correlated with the described apparatus to accommodate differing drill stems with differing threads. The output pressure may be established by the apparatus such that differing forces are generated by the hydraulic cylinders during drilling, make-up and break-out. Furthermore, the output pressure of the pump that supplies the swivel motor may be varied to provide differing torques during drilling, make-up and break-out.

While the invention has been shown in only one of its forms, it should be understood that it is not so limited but is susceptible to various changes and modifications without departing from the spirit thereof.

I claim:

1. A drill stem make-up and break-out system for earth drilling machines, said system comprising:

a power swivel adapted to rotate and raise or lower the drill stem;

a hydraulic cylinder connected with the power swivel;

a valve connected with and controlling extension or retraction of the hydraulic cylinder;

a first variable volume pump means to supply fluid to the valve and hydraulic cylinder;

a first control means connected with the variable volume pump means for selective volume variation;

a second variable and also reversible volume pump means to supply fluid to the power swivel means;

a second control means connected with the second variable volume pump means for selected volume variation;

said first and second control means being adapted for correlation with each other whereby the power swivel may be raised or lowered in correlation with rotational speed to accommodate the thread leads of differing drill stem.

2. The system defined by claim 1 which further comprises:

pressure control means connected with the first pump; and pressure control means connected with the second pump.

3. The system defined by claim 1 in which said first and second control means each comprise an electromechanical servo pump controller that is electrically controlled through variable resistors.

4. The system defined by claim 3 in which the first control means includes a first variable resistor to set the associated servo pump controller to determine a selected make-up linear speed for the power swivel, and a second variable resistor to set the same servo pump controller to determine a selected break-out linear speed for the power swivel.

5. The system defined by claim 4 in which the second control means includes a first variable resistor to set the associated servo pump controller to determine a selected rotary speed for the power swivel, and a second variable resistor to set the same servo pump controller to determine a selected rotary speed for the power swivel.

6. A drill stem make-up and break-out system for earth drilling machines, said system comprising:

a hydraulic swivel adapted to raise or lower, as well as rotate, the drill stem;

motor means to rotate the swivel;

at least one hydraulic means connected with the swivel to move it upward or downward during make-up and break-out and during drilling;

a pump, with variable volume control means, connected with the motor means of the swivel;

a pump, with variable volume control means, connected with the hydraulic means;

means to synchronize the linear displacement and rotational speed of said swivel to correlate with the lead of the threads of said drill stem during make-up and break-out.

7. The system of claim 6 wherein each said pump is connected with pressure control means.

8. The system of claim 6 which further includes a drilling pump selectively connected with said hydraulic means to provide a different drilling, linear speed for the power swivel.

* * * * *

UNITED STATES PATENT OFFICE

CERTIFICATE OF CORRECTION

Patent No. 3,942,592 Dated March 9, 1976

Inventor(s) Lee Roy Hodge

It is certified that error appears in the above-identified patent and that said Letters Patent are hereby corrected as shown below:

Column 3, lines 56 and 60, "motors" is changed to read ---pumps---.

Signed and Sealed this

Twenty-eighth Day of September 1976

[SEAL]

*Attest:*

RUTH C. MASON
*Attesting Officer*

C. MARSHALL DANN
*Commissioner of Patents and Trademarks*